United States Patent [19]

Weldon

[11] Patent Number: 4,621,561

[45] Date of Patent: Nov. 11, 1986

[54] SWITCH FOR INDUCTIVE ENERGY STORE TRANSFER CIRCUIT

[75] Inventor: William F. Weldon, Austin, Tex.

[73] Assignee: Board of Regents, Univ. of Texas System, Austin, Tex.

[21] Appl. No.: 506,887

[22] Filed: Jun. 22, 1983

[51] Int. Cl.[4] ..... H01H 29/00; F41F 1/02

[52] U.S. Cl. ..... 89/8; 200/150 R; 200/150 A; 200/150 D; 200/185; 200/193; 200/208; 335/48

[58] Field of Search ..... 89/8; 124/3; 310/10–14; 376/108; 200/81.6, 81.9 M, 148 G, 150 R, 150 A, 150 B, 150 D, 185, 182, 186, 187, 190, 193, 194, 208, 233, 235, 144 R; 335/47–51; 307/131, 132 R, 132 E, 132 M

[56] References Cited

U.S. PATENT DOCUMENTS

| | | | |
|---|---|---|---|
| 3,267,230 | 8/1966 | Schonfeld | 200/81.6 |
| 3,474,339 | 10/1969 | Rioux | 335/47 |
| 3,582,590 | 6/1971 | Eubank | 200/81.6 |
| 3,588,408 | 6/1971 | Beausoleil | 200/81.6 |
| 3,727,017 | 4/1973 | Schlesman | 200/81.6 |
| 4,138,600 | 2/1979 | Ozols | 200/61.47 |

FOREIGN PATENT DOCUMENTS

| | | | |
|---|---|---|---|
| 49-32094 | 8/1974 | Japan | 200/233 |
| 1538194 | 1/1979 | United Kingdom | 200/233 |
| 0708428 | 1/1980 | U.S.S.R. | 335/47 |
| 0828243 | 5/1981 | U.S.S.R. | 200/187 |
| 0871246 | 10/1981 | U.S.S.R. | 200/182 |
| 0904009 | 2/1982 | U.S.S.R. | 335/47 |

*Primary Examiner*—David H. Brown
*Assistant Examiner*—John E. Griffiths
*Attorney, Agent, or Firm*—Arnold, White & Durkee

[57] ABSTRACT

A switch for use in an inductive energy store transfer circuit utilizes a quantity of electrically conductive liquid bidirectionally flowable between a position that establishes electrical connection between electrodes and a position that opens electrical connection between the electrodes. High pressure gas biases the liquid to a position that establishes electrical connection between the electrodes, and yieldably resists movement of the liquid toward the position that opens electrical connection between the electrodes. Current through the switch electrodes produces a magnetic force that acts on the liquid and urges it toward the position that opens electrical connection between the electrodes. Switching action occurs upon a predetermined magnitude of current being attained.

18 Claims, 7 Drawing Figures

SWITCH FOR INDUCTIVE ENERGY STORE TRANSFER CIRCUIT

BACKGROUND OF THE INVENTION

The present invention relates to switches for use in inductive energy storage systems. More particularly, the present invention relates to switches providing opening or transfer switching action in energy transfer from an inductive energy stored source.

An inductive energy storage system includes a primary energy source, an inductor, and a primary switch element. A generalized diagram of an inductive store energy transfer circuit is shown in FIG. 1. The function of the switch in the circuit is to establish a sufficient voltage across the load terminals to transfer the current out of the switch and into the load. Any number of fundamentally different mechanisms may be used to accomplish the function. These include: varying the resistance of the switch element to establish an IR voltage drop across the load terminals, changing the inductance of the switch element to create an I dL/dt voltage across the load terminals, or a combination thereof.

Inductive energy storage systems are finding use as the power source in railguns. In an inductive energy storage system for such purpose, the primary energy source is typically a homopolar generator. A diagram of a simple homopolar generator (HPG) powered railgun circuit is shown in FIG. 2. The accelerating force in a parallel railgun accelerator is obtained by the interaction of the current in the driven armature with the magnetic field produced by the current in the rails. The switching requirements are especially severe.

In operation, the homopolar generator is motored up to speed and then switch $S_1$ is closed discharging the HPG into the inductor L through switch $S_2$. The current in the inductor rises to a peak in 0.1. to 0.5 seconds at which time switch $S_2$ having carried in excess of $10^5$ coulombs must open, thereby transfering the current into the railgun. The current vaporizes the fuse creating an arc which accelerates the projectile by the Lorentz force.

Additional switching performance requirements are present in injected or distributed energy store railguns, because the opening of the switch $S_2$ must be synchronized with the position of the moving projectile. Also, because the fuse is in parallel with switch $S_2$ during charging of the inductor, current flows through the fuse producing heating action therein and possibly premature motion thereof.

A more desirable, but more difficult switching function is adopted in the railgun circuit diagram in FIG. 3. The operation of this circuit is similar to that shown in FIG. 2 except that when peak current is reached in the inductor, switch $S_2$ is switched from position A to position B. This switching action introduces the fuse into the active circuit.

An additional requirement in practical railgun realization is that the energy transfer switch must be capable of dissipating heat generated therein, and should be capable of repetitive operation with only minor maintenance between shots. The seriousness of the heating problem is brought into focus when it is noted that in typical railgun operation a peak inductor current of $10^6$ amperes is transferred in $5\times10^{-4}$ seconds at 1,000 volts, the energy dissipated in the switch is approximately $2.5\times10^5$ Joules.

SUMMARY OF THE INVENTION

The present invention provides opening switch and transfer switch structures suitable for use in inductive energy store circuits and other applications requiring high current, high voltage switching.

In accordance with one aspect of the present invention, an opening switch for breaking a connection between a pair of electrical conductors is provided. The opening switch structure includes first and second electrodes, each for connection to one of the paired conductors. The electrodes are disposed adjacent one another, and oriented so that the first electrode carries electrical current in one direction and the second electrode carries electrical current in the opposite direction. A quantity of an electrically conductive liquid establishes electrical connection between the electrodes. The liquid is bidirectionally flowable between a position that establishes electrical connection between the electrodes and a position that opens electrical connection between the electrodes. Means is further included for biasing the liquid to the position that establishes electrical connection between the electrodes and for yieldably resisting movement of the liquid toward the position that opens electrical connection between the electrodes.

In operation, the flow of oppositely-directed currents in the electrodes develops a magnetic force that acts on the electrically conductive liquid and urges it toward the position that opens electrical connection between the electrodes. When a predetermined peak electrical current is reached, the biasing means yields and electrical connection between the electrodes is opened.

Further in accordance with this aspect of the present invention, the opening switch structure comprises a closed container having a bottom and an upstanding wall. The first and second electrodes extend into the interior of the container with the second electrode circumscribing the first electrode. The first and second electrodes define an inner chamber space, and the second electrode and the container wall define an outer chamber space. The electrically conductive liquid is bidirectionally flowable between the inner and outer chamber spaces. A gas under high pressure is disposed within the outer chamber space and biases the liquid into the inner chamber space so as to establish an electrical current path between the electrodes. The gas yieldably resists expelling movement of the liquid from the inner chamber space.

Preferably, the electrically conductive liquid comprises a liquid metal. Also, the gas preferably comprises nitrogen or sulfur hexafloride. Additionally, the switch structure may include a quantity of dielectric oil disposed within the inner chamber space for insulating between the electrodes upon expulsion of the electrically conductive liquid.

In accordance with another aspect of the present invention, a transfer switch for breaking a connection between first and second conductors and establishing a connection between the first conductor and a third conductor is provided. The transfer switch includes first, second and third electrodes, each for connection to one of three conductors. The first and second electrodes are disposed parallel to one another and carry electrical current in opposite directions. The third electrode is disposed adjacent the first electrode and on the opposite side thereof from the second electrode. A quantity of an electrically conductive liquid is disposed for bidirectional flow between a first position that establishes electrical connection between the first and second electrodes and a second position that establishes electrical connection between the first and third electrodes. Means is provided for biasing the liquid to the position that establishes electrical connection between the first and second electrode. The means further yieldably resists movement of the liquid to the second position.

In operation, the oppositely directed currents in the first and second electrodes develops a magnetic force that acts on the electrically conductive liquid and urges it toward the second position. When a predetermined peak electrical current is reached, the biasing means yields and electrical connection is established between the first and third electrodes.

BRIEF DESCRIPTION OF THE DRAWINGS

A written description setting forth the best mode presently known for carrying out the present invention, and of the manner of implementing and using it, is provided by the following detailed description of a preferred embodiment which is illustrated in the attached drawings wherein.

DETAILED DESCRIPTION OF ILLUSTRATIVE EMBODIMENTS

Figure 1:
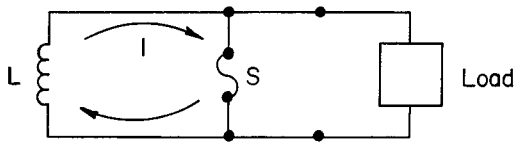
FIG. 1 is a schematic diagram of a basic inductive store energy transfer circuit.
Figure 2:
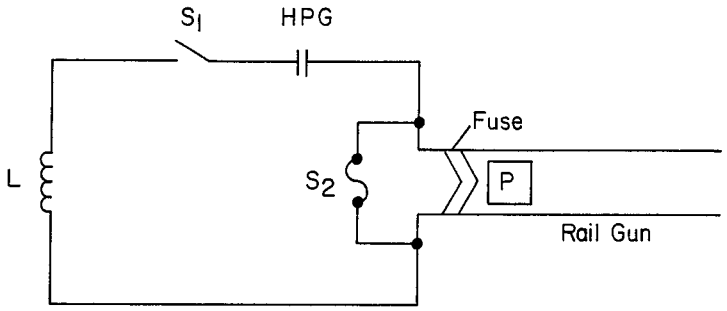
FIG. 2 is a schematic diagram of a simple homopolar generator powered railgun using an opening switch.
Figure 3:
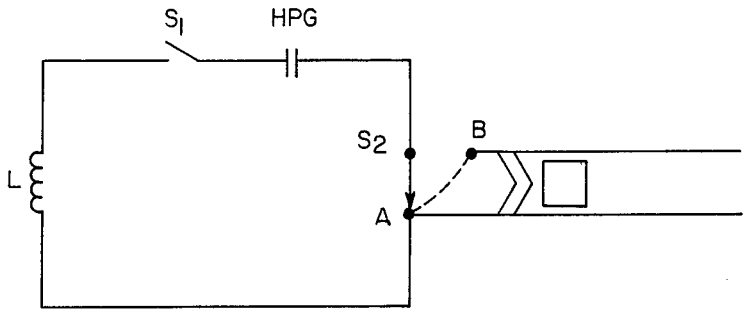
FIG. 3 is a schematic diagram of a simple homopolar generator powered railgun with a transfer switch.
Figure 4:
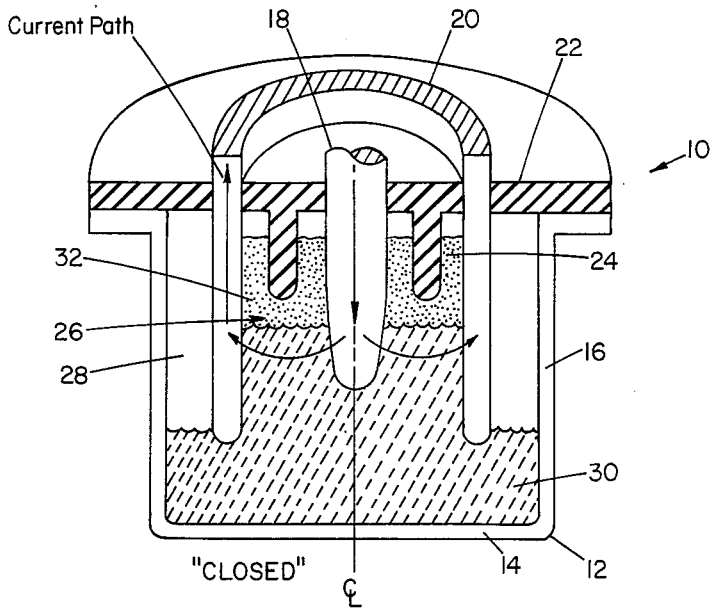
FIG. 4 shows an opening switch in accordance with the present invention in the closed position.
Figure 5:
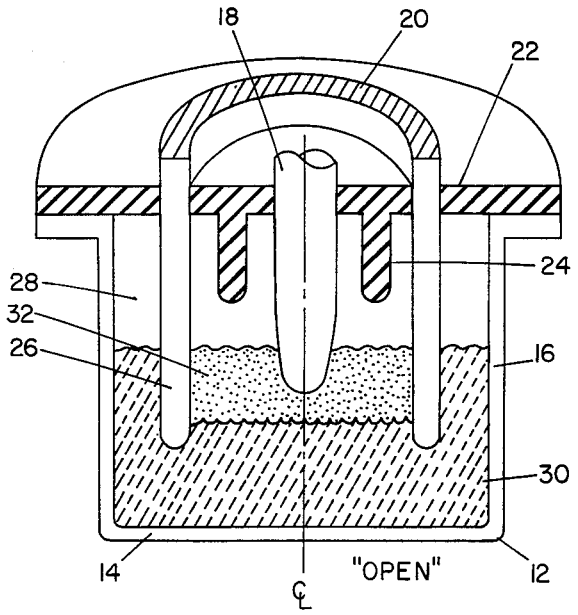
FIG. 5 shows the opening switch of FIG. 4 in the open position.

Referring now to FIG. 4 and FIG. 5, there is shown an opening switch 10 in accordance with the present invention. In FIG. 4, the switch is shown in the closed position, and in FIG. 5, the switch is shown in the open position.

Switch 10 includes a container 12 having a bottom 14 and upstanding wall 16. A first electrode 18, preferably a round rod, extends into the interior of the container. A second electrode 20 extends into the interior of the container and circumscribes electrode 18. Also, electrode 20 is preferably cylindrical and coaxial with electrode 18. A container cover 22 of an electrically insulating material is provided to form a closed container. Electrodes 18 and 20 extend through container cover 22. Additionally, cover 22 may include a cylindrical member 24 projecting from the underside. Member 24 is made of an electrically insulating material and extends over a portion of electrode 18.

Electrodes 18 and 20 define an inner chamber space 26. Electrode 18 and the container wall 16 define an outer chamber space 28. A quantity of an electrically conductive liquid 30, preferably a liquid metal, is disposed in the container, and is bidirectionally flowable between the inner and outer chamber spaces. Also included in the inner chamber space above the liquid 30 is a body of dielectric oil 32. A gas under high pressure is disposed within the outer chamber space and serves to bias the liquid metal 30 into the position shown in FIG. 4. In this position, the liquid metal establishes an electrical current path between the electrodes. Additionally, high pressure gas may be disposed within the inner chamber space above dielectric oil 32.

In operation, current flow through switch 10 has current flowing in a first direction through electrode 18 and flowing in the opposite direction through electrode 20. The arrows in FIG. 4 illustrate the current flow paths. When current through the switch reaches a predetermined magnitude, a magnetic force produced by the current and acting on liquid metal 30 causes the liquid metal to move to the position shown in FIG. 5. In that position, electrical connection between the electrodes is opened. Additionally, the dielectric oil becomes disposed between the electrodes.

Figure 6:
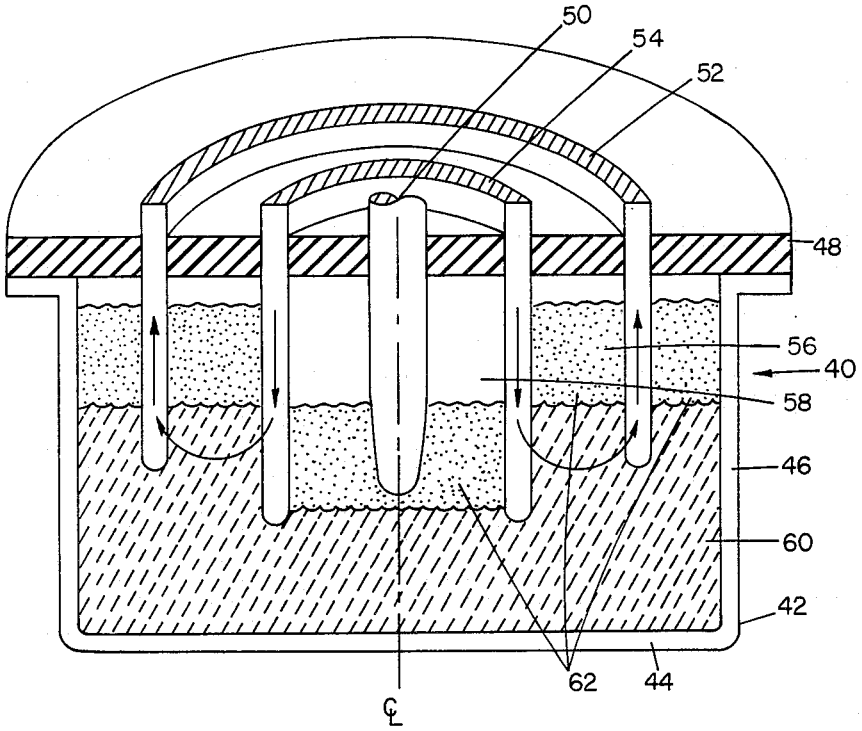
FIG. 6 shows a transfer switch in accordance with the present invention in a first switch position.
Figure 7:
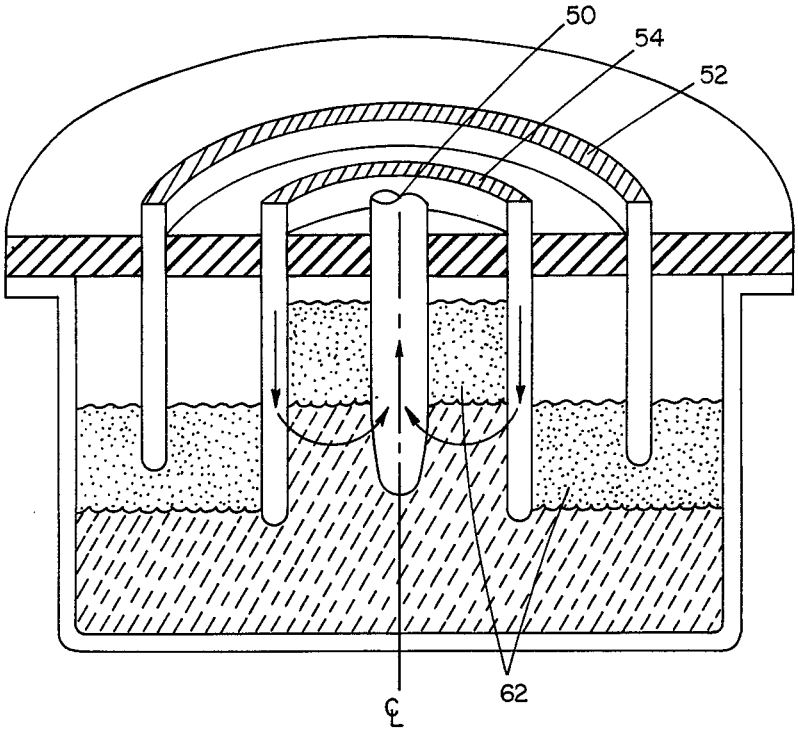
FIG. 7 shows the transfer switch of FIG. 6 in the second switch position.

Referring now to FIG. 6 and FIG. 7, there is shown a transfer switch 40 in accordance with the present invention. Switch 40 is similar in structure to opening switch 10, but includes a third electrode for connection to a third conductor. Switch 40 has a closed container 42 that includes a bottom 44, an upstanding wall 46, and a container cover 48. The first electrode 50 extends through cover 48 into the interior of the container. A second electrode 52 extends into the interior of the container and circumscribes electrode 50. The third electrode 54 extends into the interior of the container and is disposed between the electrodes 50 and 52. Electrode 54 serves as the common electrode of the switch. As shown, electrodes 52 and 54 are preferably cylindrical, and electrode 50 is preferably a round rod.

Electrodes 52 and 54 define a chamber space 56. Electrodes 50 and 54 define a chamber space 58. A quantity of an electrically conductive liquid 60 disposed in the container is bidirectionally flowable between the chamber spaces 56 and 58. Dielectric oil 62 is also provided and is disposed above the liquid 60. The liquid is preferably a liquid metal. A gas under high pressure is disposed within chamber space 58 and urges liquid 60 into chamber space 56 to establish an electrical current path between electrodes 52 and 54. As shown in FIG. 6, switch 40 is in position "A".

Current through electrodes 52 and 54 as indicated by the arrows in FIG. 6 produces a magnetic force acting on liquid metal 60. This force urges liquid metal 60 from chamber space 56 toward chamber space 58. The gas within chamber space 58 yieldably resists movement of liquid metal 60. As shown in FIG. 7, when liquid metal 60 has been moved into chamber space 58, electrical connection is established between electrodes 50 and 54. The condition shown in FIG. 7 constitutes placement of switch 40 in position "B".

In both switches 10 and 40, the gas may comprise nitrogen. Alternately the gas may comprise sulfur hexafloride. The electrically conductive liquid used in the switches preferably comprises a liquid metal. For example, a low melting point metal alloy such as a sodium-potassium eutectic may be used. Also, alloys commonly used as solder could be used.

The switch devices described herein provide for high current capacity and fast switching operation. The only moving components are fluids, thus reducing fatigue and wear problems.

It is to be further noted that by changing the relative heights of the electrodes and the volumes of the chamber spaces in the switch structures shown, the timing of the switch operation can be varied. Also, by varying the cross section of the electrodes, predetermined resistance variations can be achieved. For example, as shown, the ends of both electrode 18 and electrode 50 is tapered. Tapering provides an increasing switch resistance as the liquid is expelled from around the electrode. By tapering the electrodes, a variation of 10 to 100 variation in resistance is believed to be attainable. If a larger resistance variation is desired, the electrodes could be constructed to have sections of materials with differing conductivities. For example, an electrode might have copper as the top portion, stainless steel as middle segment, and carbon at a lower end.

The foregoing description of the invention has been directed to particular preferred embodiments for purposes of explanation and illustration. It should be apparent, however, to those skilled in this art that many modifications and changes can be made in the switch structures shown without departing from the essence of the present invention. It is the intention that the following claims cover all equivalent modifications and variations as fall within the scope of the invention.

I claim:

1. An opening switch for breaking a connection between a pair of electrical conductors, comprising:

a closed container having a bottom and an upstanding wall;

a first electrode extending into the interior of the container, for carrying electrical current in a first direction;

a second electrode extending into the interior of the container and circumscribing the first electrode, for carrying electrical current in a second direction opposite to the first direction and parallel thereto;

said first and second electrodes defining a inner chamber space;

said second electrode and said container wall defining an outer chamber space;

a quantity of an electrically conductive liquid disposed in said container for bidirectional flow between the inner and outer chamber spaces; and a gas under high pressure disposed within the outer chamber space, for biasing said liquid into the inner chamber space so as to establish an electrical current path between the electrodes, and for yieldably resisting expelling movement of the liquid from the inner chamber space due to magnetic force developed by a flow of oppositely directed electrical currents in the electrodes.

2. The switch of claim 1 wherein the electrically conductive liquid comprises a liquid metal.

3. The switch of claim 1 wherein the gas comprises nitrogen.

4. The switch of claim 1 wherein the gas comprises sulfur hexafloride.

5. The switch of claim 1 further comprising a quantity of dielectric oil disposed within the inner chamber space, for insulating between the electrodes upon expulsion of the electrically conductive liquid.

6. The switch of claim 1 further comprising an insulator disposed between the electrodes and extending into the inner chamber space.

7. The switch of claim 1 wherein the first electrode comprises a rod and the second electrode comprises a tublular member coaxially aligned with the rod.

8. The switch of claim 7 wherein the rod electrode tapers at an end, to produce an increasing switch resistance as the liquid is being expelled from the inner chamber space.

9. A transfer switch for breaking a connection between first and second conductors and establishing a connection between the first conductor and a third conductor, comprising:

a closed container having a bottom and an upstanding wall;

a first electrode extending into the interior of the container, for connection to a first conductor and for carrying electrical current in a first direction;

a second electrode extending into the interior of the container and circumscribing the first electrode for connection to a second conductor and for carrying current in a second direction opposite to the first direction and parallel thereto;

a third electrode extending into the interior of the container and disposed to be circumscribed by the second electrode, for connection to a third conductor;

said first and second electrodes defining a first chamber space;

said first and third electrodes defining a second chamber space;

a quantity of an electrically conductive liquid disposed in said container, said liquid being bidirectionally flowable between the first and second chamber spaces; and a gas under high pressure disposed within the second chamber space, for biasing said liquid to establish an electrical current path between the first and second electrodes, and for yieldably resisting expulsion of the liquid from the first chamber space and into the second chamber space due to magnetic force developed by oppositely directed currents in the first and second electrodes.

10. The switch of claim 9 wherein the electrically conductive liquid comprises a liquid metal.

11. The switch of claim 9 wherein the gas comprises nitrogen.

12. The switch of claim 9 wherein the gas comprises sulfur hexafloride.

13. The switch of claim 9 further comprising a quantity of dielectric oil disposed within the inner chamber, for insulating between the electrodes upon expulsion of the electrically conductive liquid.

14. The switch of claim 9 wherein the third electrode comprises a rod and the first electrode comprises a tubular member coaxially aligned with the rod.

15. The switch of claim 14 wherein the rod electrode tapers at an end, to produce an increasing switch resistance as the liquid is being expelled from the inner chamber space.

16. A transfer switch for breaking a connection between first and second conductors and establishing a connection between the first conductor and a third conductor, comprising:

a first electrode for connection to a first conductor, for carrying electrical current in a first direction;

a second electrode for connection to a second conductor, said second electrode being disposed adjacent the first electrode, for carrying electrical current in a second direction opposite to the first direction and parallel thereto;

a third electrode for connection to a third conductor, said third electrode being disposed adjacent the first electrode and on the opposite side thereof from the second electrode;

a quantity of an electrically conductive liquid disposed for bidirectional flow between a first position that established electrical connection between the first and second electrodes and a second position that establishes electrical connection between the first and third electrodes; and a quantity of gas under pressure for biasing the liquid to the position that establishes electrical connection between the first and second electrodes, and for yieldably resisting movement of the liquid to the second position due to the magnetic force developed by the oppositely-directed currents in the first and second electrodes.

17. A method of breaking an electrical connection between a pair of conductors, comprising the steps of:

providing first and second electrodes, each electrode being connected to one of the conductors, the electrodes being disposed parallel to one another so that the first electrode carries electrical current in a first direction and the second electrode carries electrical current in a second direction opposite to the first direction;

providing a quantity of electrically conductive liquid for bidirectional flow between a position that establishes electrical connection between the electrodes and a position that opens electrical connection between the electrodes;

providing a quantity of gas under pressure for biasing the liquid to the position that establishes electrical connection between the electrodes and for yieldably resisting movement of the liquid to the position that opens electrical connection between the electrodes; and flowing electrical current through the electrodes sufficient to produce a magnetic force that moves the liquid to the position that opens the electrical connection between the electrodes.

18. A method of breaking an electrical connection between first and second conductors and establishing an electrical connection between the first conductor and a third conductor, comprising:

providing first, second and third electrodes, each electrode being connected to one of the conductors, the first and second electrodes being disposed adjacent to one another so that the first electrode carries electrical current in a first direction and the second electrode carries electrical current in a second direction opposite to the first direction;

providing a quantity of electrically conductive liquid for bidirectional flow between a first position that establishes electrical connection between the first and second electrodes and a second position that establishes electrical connection between the first and third electrodes;

providing a quantity of gas under pressure for biasing the liquid to the position that establishes electrical connection between the first and second electrodes and for yieldably resisting movement of the liquid to the second position; and flowing electrical current through the first and second electrodes sufficient to produce a magnetic force that moves the liquid to the position that establishes electrical connection between the first and third electrodes.

* * * * *